US006474398B1

(12) United States Patent
Schoner et al.

(10) Patent No.: US 6,474,398 B1
(45) Date of Patent: Nov. 5, 2002

(54) APPARATUS FOR INTRODUCING GRANULAR MOLD FLUX ONTO THE TOP OF A SLAB BEING CAST WITHIN A CONTINUOUS CASTING MOLD

(75) Inventors: Frank Schoner, Lancaster, NY (US); Michael D. Zinni, Niagara Falls, NY (US)

(73) Assignee: Stollberg, Inc., Niagara Falls, NY (US)

( * ) Notice: Subject to any disclaimer, the term of this patent is extended or adjusted under 35 U.S.C. 154(b) by 0 days.

(21) Appl. No.: 09/498,220

(22) Filed: Feb. 4, 2000

Related U.S. Application Data

(63) Continuation-in-part of application No. 09/154,556, filed on Sep. 16, 1998, now abandoned.

(51) Int. Cl.[7] ..... B22D 11/16; B05B 7/00

(52) U.S. Cl. ..... 164/268; 118/308

(58) Field of Search ..... 164/268, 470, 164/472, 473, 412, 267, 150.1, 151.2, 154.1, 155.1, 155.2, 155.4, 449.1; 222/64, 527; 239/13; 118/308; 251/5

(56) References Cited

U.S. PATENT DOCUMENTS

| | | | | |
|---|---|---|---|---|
| 3,900,065 A | | 8/1975 | Giunta et al. | |
| 4,084,626 A | * | 4/1978 | King | 141/7 |
| 4,084,628 A | | 4/1978 | Schmid | |
| 4,111,492 A | * | 9/1978 | Mraz | 302/39 |
| 4,116,367 A | * | 9/1978 | Kataoka et al. | 222/144.5 |
| 4,372,528 A | * | 2/1983 | Raftis | 251/4 |
| 4,436,277 A | * | 3/1984 | Robak et al. | 251/6 |
| 4,595,045 A | | 6/1986 | Mangin et al. | |
| 5,158,129 A | * | 10/1992 | Hubert et al. | 164/452 |
| 5,474,609 A | * | 12/1995 | Mulder et al. | 118/308 |
| 5,544,811 A | * | 8/1996 | Tillery et al. | 239/13 |

FOREIGN PATENT DOCUMENTS

| | | | |
|---|---|---|---|
| DE | 2321847 | 11/1974 | |
| FR | 1474697 | 2/1967 | |
| FR | 2407773 | 7/1979 | |
| FR | 2635029 | 2/1990 | |
| FR | 2635029 A1 * | 2/1990 | B22D/11/07 |
| JP | 49-37893 | 10/1974 | |

* cited by examiner

*Primary Examiner*—M. Alexandra Elve
*Assistant Examiner*—Kevin P. Kerns
(74) *Attorney, Agent, or Firm*—John C. Thompson

(57) ABSTRACT

A continuous casting apparatus includes a dispensing assembly for introducing granular mold flux onto the top of a slab being cast within a continuous casting mold. The apparatus has a delivery apparatus for feeding granular mold flux from an intermediate hopper to the top of a slab being cast, and the delivery apparatus has at least one delivery tube assembly interconnected with the intermediate hopper, with a mechanism for controlling the flow rate of the mold flux through the delivery tube assembly. In the first two embodiments, the flow rate control mechanism is a variable diameter pinch valve located between the intermediate hopper and the delivery tube assembly. In the third and fourth embodiments, the flow rate control mechanism is an air pump and a mechanism for varying the air volume through the air pump so that the granular mold flux delivered is a function of the air volume of the air pump.

4 Claims, 7 Drawing Sheets

AIR
50
49
24
32
30
20
26
24.31
22
46
CONTROL
48
58
56
54
16
18
20
12
14
28
64
PRESSURE CONTROL VALVE
68
AIR INPUT
66
FEED CONTROL PANEL
70
10

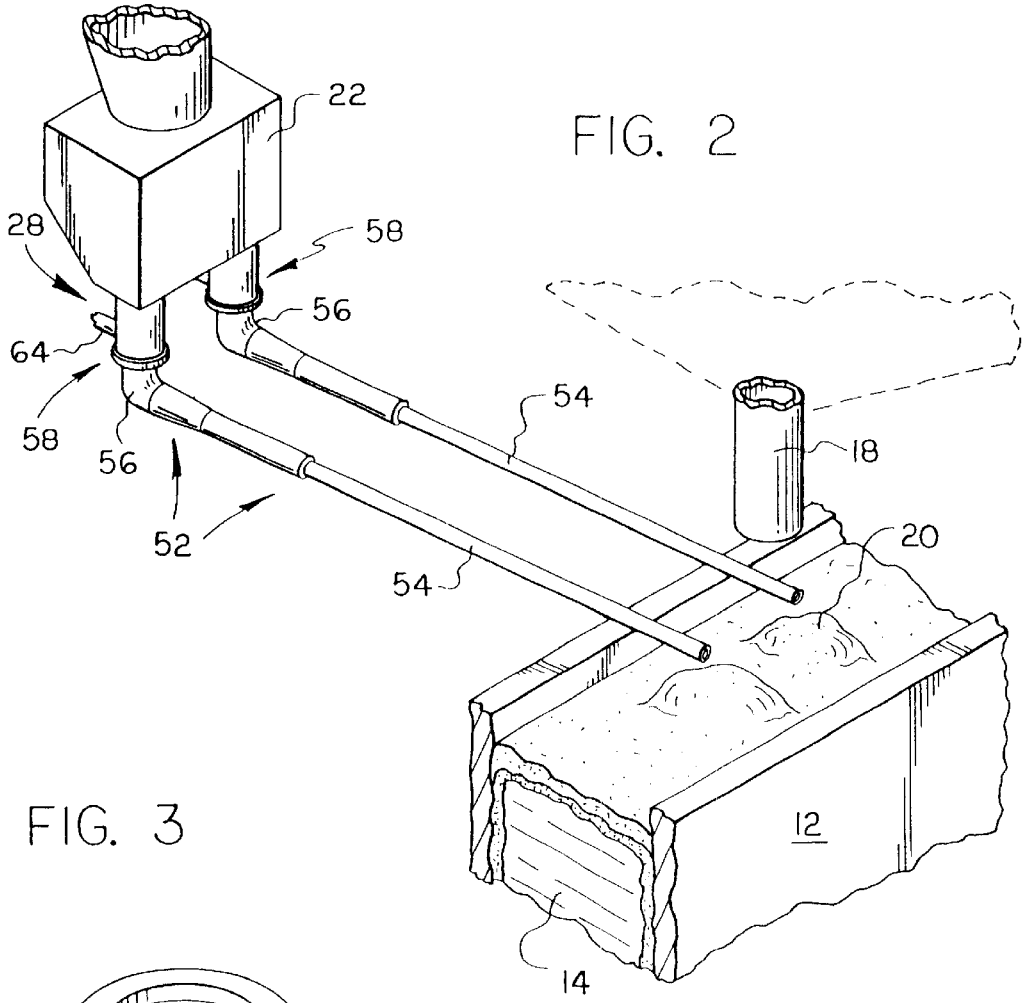
FIG. 2
FIG. 3
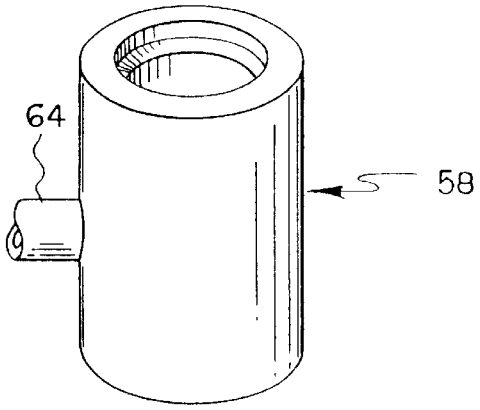
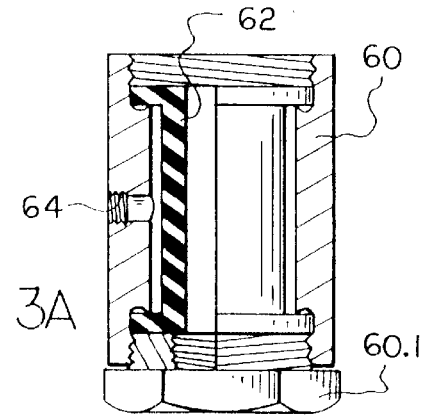
FIG. 3A

FIG. 9
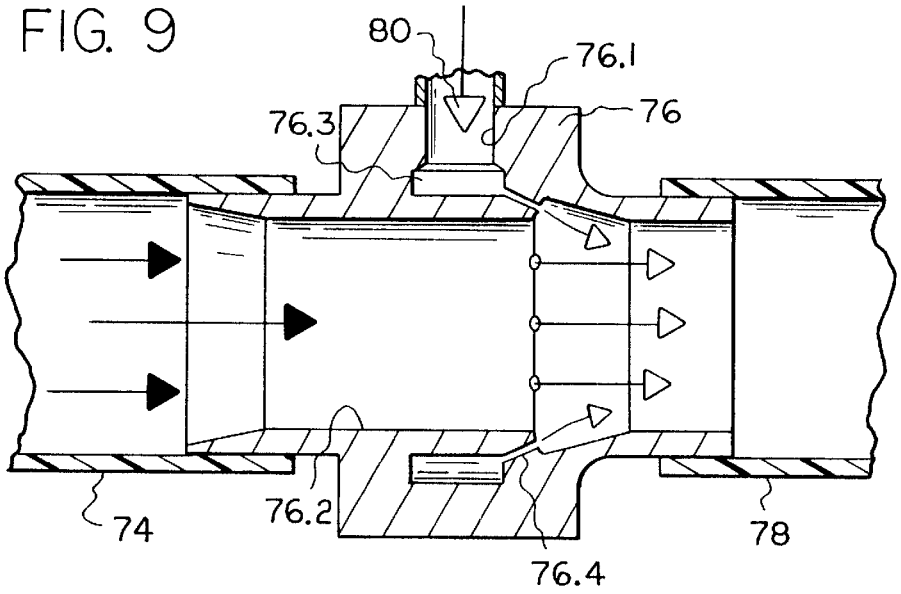
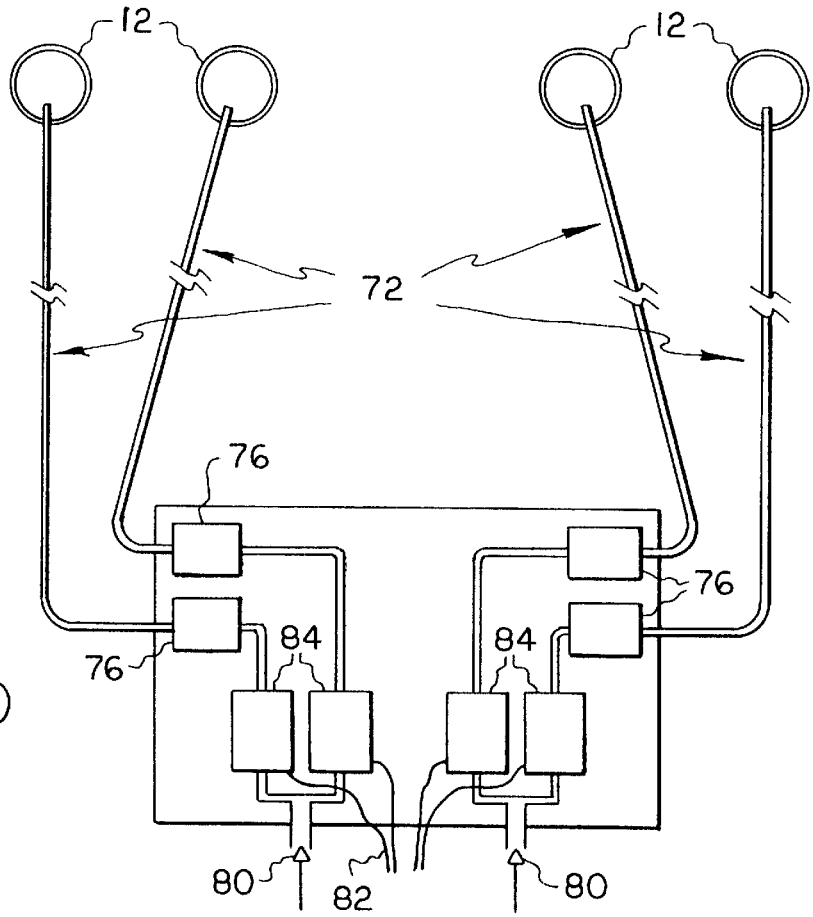
FIG. 10

APPARATUS FOR INTRODUCING GRANULAR MOLD FLUX ONTO THE TOP OF A SLAB BEING CAST WITHIN A CONTINUOUS CASTING MOLD

CROSS REFERENCE TO RELATED APPLICATIONS

This application is a continuation-in-part of applicants' U.S. patent application Ser. No. 09/154,556, filed Sep. 16, 1998, now abandoned.

TECHNICAL FIELD

The present invention relates generally to the metal casting field wherein molten steel may be continuously cast into a slab of steel, and more particularly to an apparatus for introducing a granular mold flux onto the top of the slab being cast within a continuous casting mold.

BACKGROUND OF THE INVENTION

It is customary to apply a mold flux, which may be a powder or granular material, onto the top of a slab during continuous casting of a molten metal, typically steel, as shown in U.S. Pat. No. 4,084,626, the flux turning into slag when sufficiently heated by the molten steel. In practice, it is desirable to have about 1–3 inches of flux or slag on top of the mold during casting. The device illustrated in the foregoing patent is for feeding a mold flux in the form of a powder. The powder has poor flow characteristics, and thus a screw feed mechanism is used, which screw extends between an intermediate hopper (or bin) and the top of the slab being cast. This form of device is somewhat expensive and, in fact, is not typically used in industry because of its cost and unreliable operation. Thus, it is common today to merely sweep the mold flux onto the top of the slab when desired, the flux being provided in 10 kg. bags. This system works well, but it is manpower intensive. In addition, it is environmentally unfriendly as there is a lot of refuse from the empty 10 kg. bags.

U.S. Pat. Nos. 4,595,045 and 5,158,129 disclose method and apparatus for applying a layer of flux to the top of a slab being cast. In both of these designs, the delivery pipe (or supply pipe) is positioned slightly above the predetermined powder height, so that flow through the pipe is regulated by how fast the flux material flows away from the discharge end of the pipe. Thus, when the powder level drops below the delivery end opening, material flows from the pipe. This form of apparatus, which relies solely upon the flow of material away from the delivery pipe, has not always been satisfactory since occasionally the end of the delivery pipe will become blocked by slag or the like, and rigid piping at a sufficient flow angle is needed that is too much of a hindrance at the caster.

OBJECTS AND SUMMARY OF THE INVENTION

It is an object of the present invention to provide an apparatus for introducing a granular mold flux onto the top of a slab being cast within a continuous casting mold wherein the flux may be introduced at a substantially constant rate.

It is a further object of the present invention to provide an apparatus for introducing a granular mold flux onto the top of a slab being cast within a continuous casting mold which is environmentally friendly, of low cost, and reliable.

It is yet another object of the present invention to provide an apparatus of the type set forth above which requires less manpower and permits remote operator control unlike commonly used systems of today.

More particularly, it is an object of this invention to provide an apparatus having delivery means for feeding granular mold flux from an intermediate hopper to the top of the slab being cast, the delivery means including at least one delivery tube assembly interconnected with the intermediate hopper, and a variable pinch valve located between the intermediate hopper and the delivery tube for controlling the flow rate of the granular mold flux through the delivery tube.

It is a further object of the present invention to provide, in an apparatus of the type set forth above, a source of granular mold flux and transfer means for transferring the granular mold flux from the source of the granular mold flux to an intermediate hopper, the intermediate hopper being provided with a sensor for controlling the level of granular mold flux within the intermediate hopper.

In summary, the foregoing objects are accomplished by providing an apparatus consisting of a vacuum transfer system which transfers the granular mold flux from a source of granular mold flux, which may be a large bulk bag (approximately 4–5 ft. on each side) to an intermediate hopper provided with a sensor a suitable distance above the bottom of the intermediate hopper. The intermediate hopper is capable of being mounted on a side of a tundish. If the sensor is covered with flux, the vacuum transfer system will be turned "off"; but when the sensor is uncovered, the transfer system will be turned "on" to refill the intermediate hopper until the sensor is again covered. From the intermediate hopper, the flux will flow through at least one delivery tube assembly onto the top of the slab being cast, which delivery tube assembly includes a delivery tube. In one embodiment the flux flows through the delivery tube assembly by gravity. In another embodiment the flow of flux through the delivery tube assembly is assured by an inline air pump. It is a feature of this invention to control the flow rate of the flux being delivered, so that the delivery rate is equal to that rate of the flux which is being consumed during casting, this being done by at least one pneumatically operated pinch valve. Thus, a pinch valve is located at the input side of each delivery tube. The diameter of the pinch valve is controlled by an operator via a control device, and in operation, the operator will set the control for the desired flow rate. If it is not right, as will be determined via a visual inspection of the top of the slab, it will be adjusted.

It is a further object of the present invention to provide an apparatus which utilizes air pumps to transfer a granular mold flux onto the top of a slab being cast within a continuous casting mold, the apparatus including a source of granular mold flux, an intermediate hopper, and one or more delivery tube assemblies interconnected with the intermediate hopper, each delivery tube assembly including an inline air pump and a flexible line, the inline air pump assuring a positive flow of flux through the flexible line. In one variation the flow rate of flux is controlled by a pinch valve, while in other variations the flow rate is controlled by varying the air volume delivered to the air pump.

The foregoing objects and other objects and advantages of this invention will become more apparent after a consideration of the following detailed description taken in conjunction with the accompanying drawings in which a preferred form of this invention is illustrated.

BRIEF DESCRIPTION OF THE DRAWINGS

FIG. 2 is a perspective view of a portion of the apparatus shown in FIG. 1, two delivery tubes being illustrated.

FIG. 3 is a view illustrating a portion of the pinch valve which may be utilized with this invention.

FIG. 3A is a cross sectional view of the pinch valve shown in FIG. 3.

FIG. 9 is a cross sectional view through an inline air pump.

FIG. 10 is a schematic view of a third embodiment of this invention.

DETAILED DESCRIPTION IN GENERAL

Figure 1:
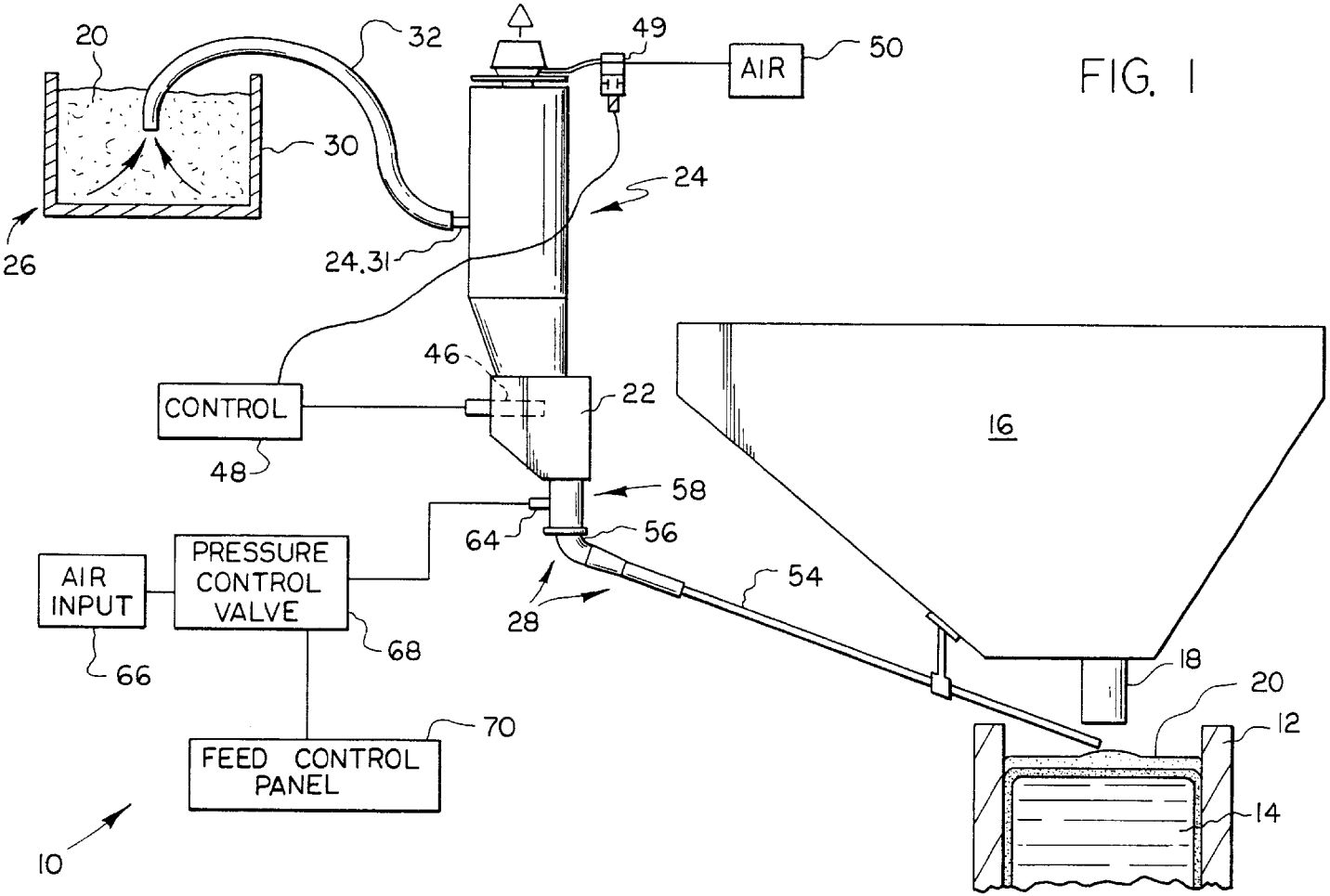
FIG. 1 is a side elevational view of a first embodiment of an apparatus of this invention, which apparatus is shown somewhat schematically wherein an intermediate hopper and pinch valve are employed, and which figure further illustrates various control means.

In the following description of the various embodiments of this invention, common parts will be represented by the same reference numerals. The apparatus of the present invention is indicated generally by the reference numeral 10. The continuous casting mold, which in the preferred embodiment is a water-cooled copper mold, is indicated by reference numeral 12. The slab being cast is indicated by reference numeral 14. The slab material, which in the preferred embodiment is molten steel, is initially fed from a tundish 16 through a ceramic pouring tube 18. The granular mold flux, which is fed onto the top of the slab in accordance with this invention, is indicated by the reference numeral 20. The flux 20 will not only be disposed on the top of the slab 14, but will also extend between the slab 14 and the mold 12 as indicated in the drawings. In this regard, the flux 20 becomes a liquid slag when heated sufficiently by the liquid steel. This molten slag is what fills the gap between the steel shell and mold wall. As is conventional, the combined flux and slag on top of the slab should be at least 1 inch thick and may be up to 3 inches in thickness.

First Embodiment

The apparatus shown in FIGS. 1 and 2 for depositing the granular mold flux onto the top of the slab being cast within the mold consists of three major components, these being an intermediate hopper 22, transfer means indicated generally at 24, and delivery means or delivery apparatus indicated generally at 28. The transfer means 24 transfers granular mold flux from a source of granular mold flux to the intermediate hopper 22, the source being indicated generally at 26. The source of granular flux may be a large bulk bag 30 approximately 4–5 ft. on each side. The delivery means 28 feeds the granular mold flux from the intermediate hopper 22 to the top of the slab via gravity.

Figure 7:
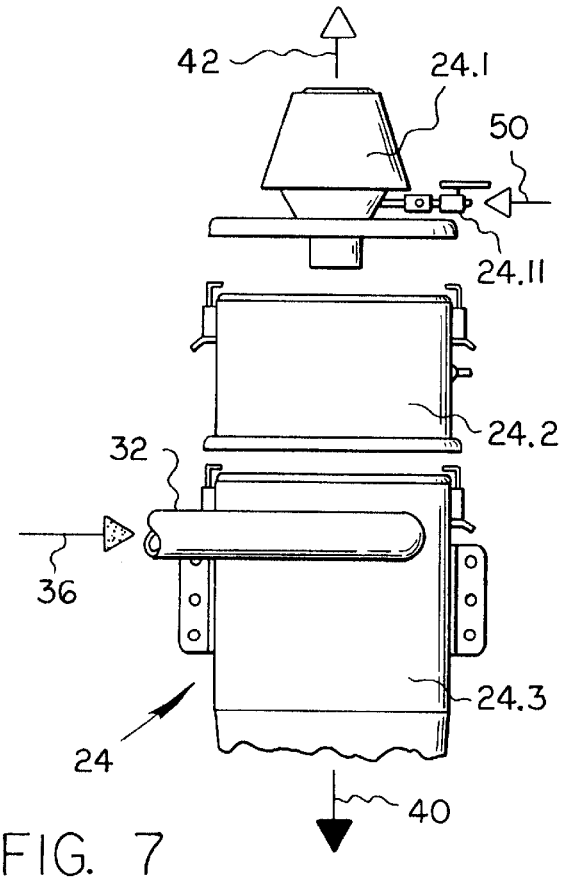
FIG. 7 is an exploded view of a vacuum transfer system which may be utilized with this invention.

The transfer means consists of a commercially available vacuum transfer system such as a Norclean™ or Vacu-Max™ vacuum transfer system. As the details of such vacuum transfer systems are well known in the art, they are only superficially schematically illustrated in FIG. 7. Thus, the unit 24 shown in FIG. 7 includes an air powered vacuum head 24.1, a filter housing 24.2, and a cyclonic separator 24.3. Such vacuum transfer devices include an intake port 24.31 (FIG. 1) to which a flexible tube and wand 32 may be connected, the wand extending into the bag 30. The transfer means 24 is connected to a source of air via port 24.11 (FIG. 7), the air entering through port 24.11 causing a vacuum to be drawn through the flexible tube and wand 32. During operation of the transfer means, a mixture of air and granular mold flux, indicated by arrow 36, will be introduced into the transfer means through port 24.31. Due to the cyclonic effect within the housing 24.3, the granular flux material will be separated from the air and will descend downwardly as indicated by the arrow 40. Exhaust air will exit from an upper portion of the transfer means as indicated by the arrow 42, the exhaust air passing through an internal filter with housing 24.2. The flux material indicated by the arrow 40 will be received within the intermediate hopper 22.

In accordance with the principles of this invention, the intermediate hopper 22 is provided with a sensor 46. The sensor or level probe 46 is in turn interconnected with control 48. If the sensor is not covered with flux, the control 48 will turn the transfer means "on". To this end, the control 48 will cause a valve 49 to be shifted from a closed position to an open position to permit shop air 50 to flow to the port 24.11, causing operation of the transfer means 24. Alternatively, if the probe 46 is covered with the granular mold flux, the control 48 will cause the valve 49 to be shifted to its closed position, turning the transfer means "off." As the granular mold flux 20 flows through the delivery means 28 by gravity, this assures an uninterrupted supply of flux to the mold while material is being transported to the vacuum system.

The delivery means 28 for feeding the granular mold flux from the intermediate hopper 22 to the top of the slab 14 within the continuous casting mold 12 of the first embodiment includes at least one delivery tube assembly indicated generally at 52. In FIG. 2, two delivery tube assemblies are illustrated, one of them terminating to one side of the ceramic pouring tube 18 and the other one terminating to the other side of the ceramic pouring tube 18. Each delivery tube assembly 52 includes a delivery tube 54 and a flexible joint or tube 56. While not shown in FIGS. 1 and 2, each delivery tube 54 may further include additional branches immediately adjacent the mold 12 so that there may be two or more deliveries from each of the delivery tube assemblies 52.

Figure 4:
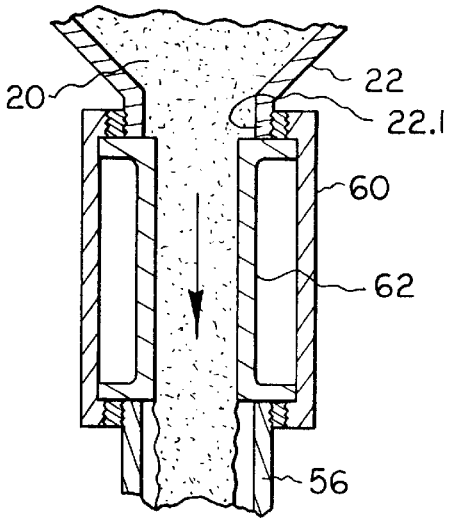
FIGS. 4, 5 and 6 are schematic sectional views of the pinch valve shown in FIG. 3, FIG. 4 illustrating the pinch valve in the full open position, FIG. 5 illustrating the pinch valve in a position where it is almost closed, and FIG. 6 illustrating the pinch valve in a closed position, the pinch valve being somewhat schematically illustrated in these figures.

The delivery means 28 also includes a pinch valve assembly, indicated generally at 58. One pinch valve which may be used is the Series 2600 pinch valve sold by the Red Valve Company, Inc., of Pittsburgh, Pa. Each of the pinch valve assemblies is located at that end of the delivery tube assembly 52 that is closest to the intermediate hopper. Each of the pinch valve assemblies 58 includes a generally cylindrical body portion 60 and opposed flanged end portions 60.1, which end portions are threaded for easy attachment. In the Series 2600 pinch valve, the flanged end portions are separate end caps 60.1 which are screwed into the central body portion 60. (These separate end caps are not shown in FIGS. 4–6 and in FIG. 3A only one end cap is shown). In the normal position of operation shown in the various figures, the upper flange or end cap 60.1 is screwed onto the lower tubular end 22.1 of the intermediate hopper 22 as can best be seen from FIG. 4. Similarly, in the normal position of operation, the lower flange or end cap 60.1 of the body 60 is screwed onto the flexible joint 56 as schematically shown in FIG. 4. The valve body receives a rubber sleeve 62 which, in its normal position as shown in FIGS. 3A and 4, will have an internal diameter of approximately 1 inch. This will assure maximum flow through the flexible joint 56 and delivery tube 54 at full pinch valve open position.

Figure 6:
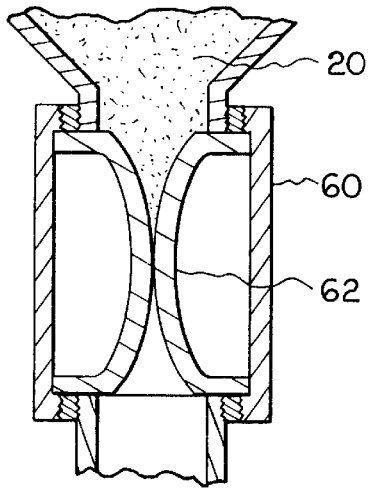
Figure 5:
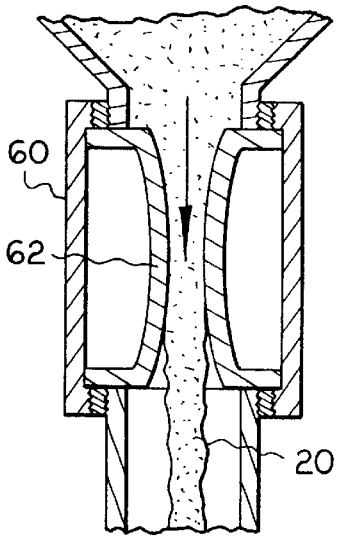

The internal diameter of the variable pinch valve is controlled via air. Thus, there is an air port 64 which is in turn interconnected with another source of shop air 66 via a pressure control valve 68, which may be a potentiometer (which may be called n I/P controller) in conjunction with an electropneumatic transducer (hereinafter I/P device) of conventional design. If air under pressure is introduced through the air port 64, the diameter of the rubber sleeve 62 will be changed. Thus, if air is introduced into the sleeve 62 at a pressure of, for example 30 psi over atmospheric, the rubber sleeve may be closed as shown in FIG. 6. However, if air is introduced at a lower pressure, for example 5 psi, the rubber sleeve will not be fully closed but its diameter will be reduced, for example to approximately ¼ inch as shown in FIG. 5. Thus, by changing the air pressure introduced into the rubber sleeve, it is possible to control the diameter of the rubber sleeve, thereby varying the flow rate of the granular mold flux through the delivery tube assembly. This is done by an operator who is stationed near a feed control panel 70 who observes the depth of the granular mold flux on the slab 14. If he sees that the flux is building up too high so that it is almost as high as the top of the mold 12, he can slow up or stop the flow. Alternatively, if he sees that hot spots are developing or showing through the flux, he can increase the flow rate. As continuous casting is a substantially steady state operation, the consumption (and feeding) of flux is substantially constant. Therefore, once the proper flow rate is dialed in, the operator need only occasionally adjust the flow rate.

As the granular mold flux has a relatively low angle of repose, it will flow through the tube 54 shown in FIGS. 1 and 2 provided it has a diameter at least as large as the internal diameter of the rubber sleeve 62 when it is in its normal operating position. It should be noted though that in the embodiment of FIGS. 1 and 2 it is necessary that the delivery tube 54 be disposed at an angle greater than the angle of repose in order to ensure flow.

The operation of the foregoing apparatus should be apparent from the above detailed description. It should be noted, though, that the present apparatus is of relatively low cost, and will provide a constant flow rate of the granular mold flux through the delivery tube to the top of the slab being cast. In addition, as there are very few moving parts, it is reliable in operation. Furthermore, it can be remotely controlled by an operator who only needs to visually inspect the top of the mold below the tundish. In addition, the present system is environmentally friendly in the sense that large containers of flux are used, rather than the conventional 10 kg. bags, thus presenting much less waste material that needs to be cleaned up at the end of a shift.

Second Embodiment

Figure 8:
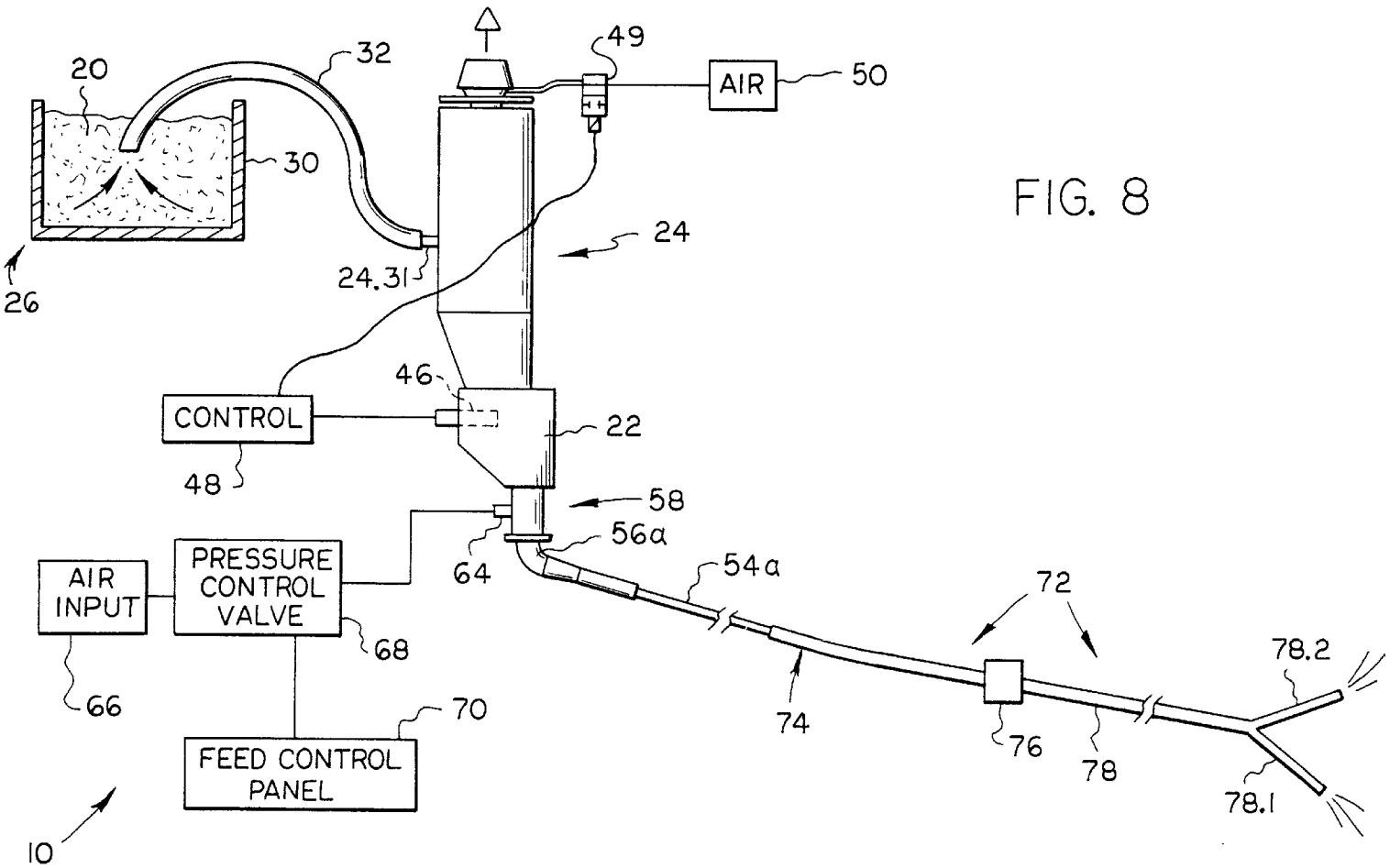
FIG. 8 is a side elevational view of a second embodiment of an apparatus of this invention, wherein an intermediate hopper, pinch valve, and inline air pump are utilized.

The second embodiment shown in FIG. 8 differs primarily from the first embodiment shown in FIGS. 1 and 2 in the design of the delivery tube assembly. However, in all other respects it is the same. Thus, the second embodiment uses the transfer means 24 to deliver granular mold flux 20 from a source 26 to an intermediate hopper 22. In addition, flow from the intermediate hopper is regulated by a variable orifice valve assembly 58 of the same design shown in FIGS. 1 through 6.

In the second embodiment the delivery tube assembly is indicated generally at 72. It includes a flexible line or tube 74, which may have a 1.5" inside diameter. While the upstream end of line 74 may be connected to the valve assembly 58, it is preferably connected to a delivery tube 54*a* which extends towards the mold, the upstream end of tube 54*a* being connected to a flexible joint 56*a* which is in turn connected to the valve assembly 58. The design of the delivery tube 54*a* and the flexible joint 56*a* is the same as in the embodiment shown in FIGS. 1 and 2. In addition, the tube 54*a* is disposed at an angle greater than the angle of repose of the granular mold flux material to ensure flow through the flexible joint 56*a* to the downstream end of delivery tube 54*a*. The downstream end of line 74 is connected to an inline air pump 76 of conventional design. The upstream end of a further delivery tube 78 is in turn connected to the inline air pump. The delivery tube may be a 1.25" i.d. conduit. While the downstream end of the tube may deliver the granular mold flux 20 directly onto the top of the slab as shown in FIG. 1, it is preferred that the tube 78 be forked in the form of a "Y", having branches 78.1 and 78.2 which deliver granular mold flux to either side of the ceramic pouring tube 18. By using the inline air pump 76, a positive flow of granular mold flux through the delivery tube assembly is assured and it is not necessary to dispose the further delivery tube 78 at an angle greater than the angle of repose for the granular mold flux. The use of a flexible line 74 permits ready service of the further tube 78, as it may be withdrawn from the operational position where its end is above the mold to another position. The inline air pump assures flow through the flexible line 74, which may sag during use as well as through the further delivery tube 78. In addition, the inline air pump causes the granular mold flux to be spread for good coverage. The inline air pump 76 is shown in FIG. 9. It is provided with a port 76.1 which receives shop air represented by arrow 80, the shop air in turn entering bore 76.2 through an annular plenum chamber 76.3 and nozzles 76.4.

Third Embodiment

Figure 10A:
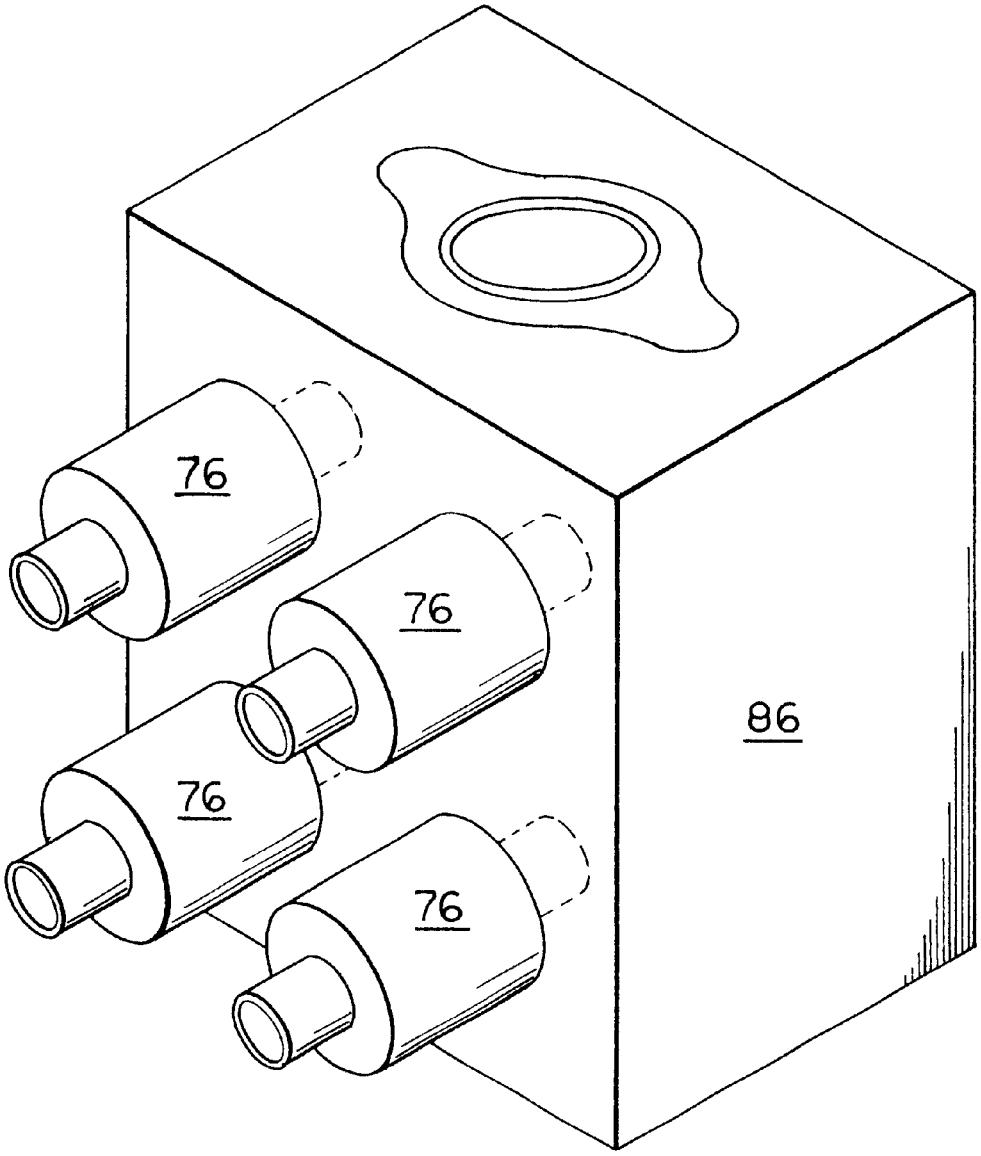
FIG. 10A is a view of an intermediate hopper to which the air pumps of the third embodiment are associated.

The third embodiment of this invention is illustrated in FIGS. 10 and 10A. This embodiment includes one inline air pump for each mold 12, four being shown. In this design air for the air pumps is controlled by a control panel (not shown) which sends a milliamp signal through electrical lines 82 to I/P devices 84 of conventional design which convert a milliamp signal to an output pneumatic pressure, the I/P devices receiving shop air indicated by arrow 80. It should be noted that the amount of flux delivered varies with air volume, and with the I/P devices used, the air volume is proportional to pressure. As can be seen from FIG. 10A, the air pumps 76 are mounted directly on an intermediate hopper 86. The intermediate hopper can in turn receive flux in the same manner as in FIG. 1, or in other manners, such as in the manner shown in the fourth embodiment.

Fourth Embodiment

Figure 11:
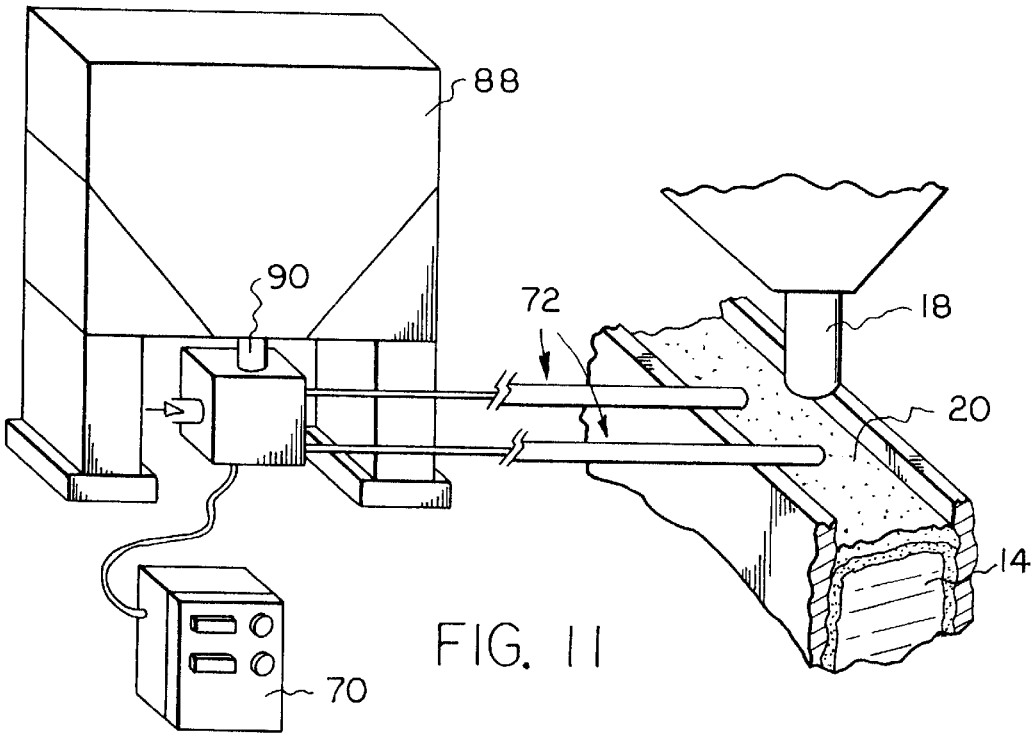
FIG. 11 is a partial perspective view of a fourth embodiment of an apparatus of this invention, wherein an intermediate hopper and two inline air pumps are utilized.
Figure 12:
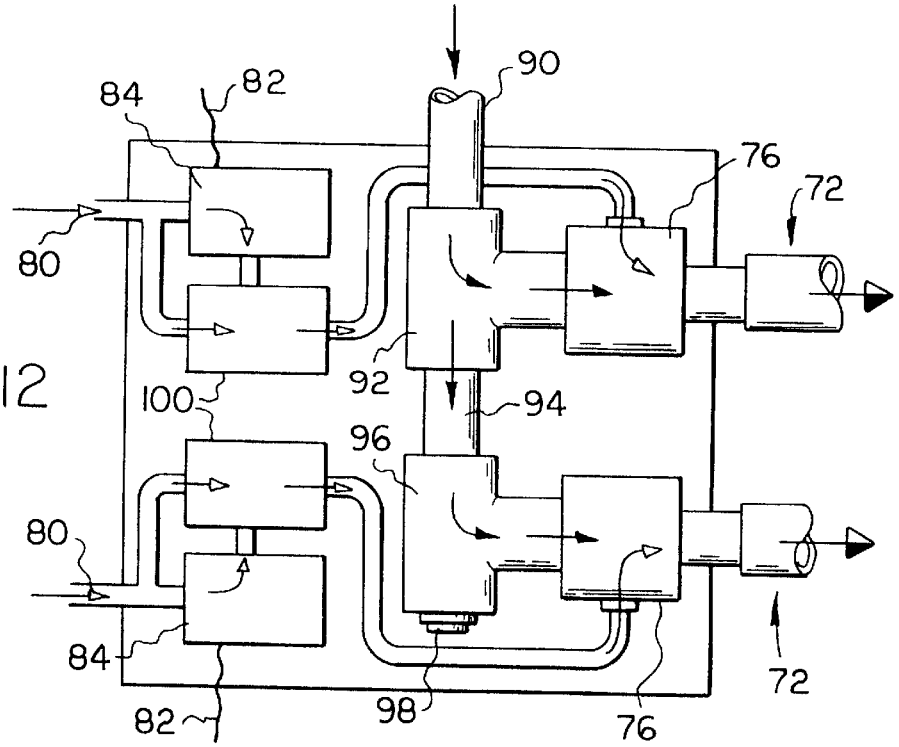
FIG. 12 is an enlarged detail view of a portion of the apparatus shown in FIG. 11.

The fourth embodiment of this invention is illustrated in FIGS. 11 and 12. In this embodiment a stationary primary hopper 88 is provided, which hopper may be filled in any manner, i.e., from individual bags of flux or from a bulk source of flux. The hopper has a discharge pipe or tube 90 to which is connected an upper "T" fitting 92, an intermediate nipple 94, and a lower "T" fitting 96 which has a plug 98 at its lower end. The "T"s and nipple 94 serve as an intermediate hopper, and as can be seen a pair of inline air pumps are connected directly to the intermediate hopper. The air pressure to each of the inline air pumps is regulated by an I/P device 82 which receives shop air 80. The output of the I/P devices is controlled by a control panel 70 (FIG. 11) which is connected to each of the I/P devices by lines 82. It has been found that in some situations the selected I/P devices are incapable of supplying sufficient air volume to deliver the desired quantities of flux, either because of the distance between the inline pumps 76 and the mold 12, or because the mold requires large quantities of flux. In these situations an air volume booster 100 of conventional design may be provided to increase the flow of air, but to maintain it at the desired pressure.

While preferred forms of this invention have been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A continuous casting apparatus including a dispensing assembly for introducing granular mold flux onto the top of a slab being cast within a continuous casting mold; the assembly comprising:

a source of granular mold flux;

an intermediate hopper which receives granular mold flux from the source;

one or more delivery tube assemblies interconnected with the intermediate hopper for feeding of the granular mold flux from the intermediate hopper to the top of the slab being cast within the continuous casting mold, each delivery tube assembly including a flexible line, and an inline air pump associated with each of said one or more delivery tube assemblies for assuring a positive flow of granular mold flux through the flexible line;

means connected to each inline air pump to progressively vary the flow rate of the granular mold flux from the inline air pump to tho top of the slab, said means varying the air volume delivered to said inline air pump.

2. The assembly for introducing granular mold flux onto the top of a slab being cast within a continuous casting mold as set forth in claim 1 wherein the apparatus is further provided with a feed control panel wherein an operator may remotely control the flow rate by either slowing up or stopping the flow if the operator sees that the flux is building up too high so that it is almost as high as the top of the mold, or by increasing the flow rate if the operator sees that hot spots are developing or showing through the flux.

3. The assembly for introducing granular mold flux onto the top of a slab being cast within a continuous casting mold as set forth in claim 1 wherein an I/P device is provided for each air pump, the air volume being delivered by the air pump being under the control of the associated I/P device.

4. The assembly for introducing granular mold flux onto the top of a slab being cast within a continuous casting mold as set forth in claim 3 wherein each I/P device is associated with an air volume booster.

* * * * *